US006501844B2

(12) United States Patent
Proni

(10) Patent No.: US 6,501,844 B2
(45) Date of Patent: Dec. 31, 2002

(54) LOUDSPEAKER AND METHOD OF ASSEMBLING SAME

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 214 days.

(21) Appl. No.: 09/733,683

(22) Filed: Dec. 8, 2000

(65) Prior Publication Data

US 2002/0071588 A1 Jun. 13, 2002

(51) Int. Cl.[7] ..... H04R 1/00
(52) U.S. Cl. ..... 381/403; 381/412; 381/423
(58) Field of Search ..... 381/396, 403, 381/412, 423, 424, 398, 407, 397, 159, 151, 152, 162, 420; 181/171, 172, 173, 159

(56) References Cited

U.S. PATENT DOCUMENTS

| | | | | |
|---|---|---|---|---|
| 3,997,023 A | | 12/1976 | White | 181/171 |
| 4,275,278 A | | 6/1981 | Sakurai et al. | 179/181 F |
| 4,410,768 A | | 10/1983 | Nakamura et al. | 179/115.5 R |
| 4,567,327 A | | 1/1986 | Goossens et al. | 179/115.5 R |
| 4,764,968 A | | 8/1988 | Kreitmeier | 381/204 |
| 5,157,731 A | | 10/1992 | Mitobe | 381/202 |
| 5,424,496 A | | 6/1995 | Kreitmeier | 181/161 |
| 5,715,324 A | | 2/1998 | Tanabe et al. | 381/199 |
| 5,734,132 A | | 3/1998 | Proni | 181/171 |
| 5,734,734 A | | 3/1998 | Proni | 381/194 |
| 5,991,425 A | | 11/1999 | Anagnos | 381/423 |
| 6,088,466 A | | 7/2000 | Proni | 381/397 |
| 6,118,884 A | * | 9/2000 | Proni | 381/403 |
| 6,229,902 B1 | * | 5/2001 | Proni | 381/400 |
| 6,243,479 B1 | * | 6/2001 | Proni | 381/420 |
| 6,327,371 B1 | * | 12/2001 | Proni | 381/397 |

* cited by examiner

*Primary Examiner*—Rexford Barnie
(74) *Attorney, Agent, or Firm*—Holland & Knight LLP

(57) ABSTRACT

A loudspeaker and method of assembling same is disclosed in which the motor structure and frame are interconnected, the voice coil is initially secured within the magnetic gap of the motor by the lower suspension and then the diaphragm and surround are installed by first affixing the surround to a flange at the upper end of the frame so that the outer diameter of the surround is concentric to its inner diameter, and then inserting the lower end of the diaphragm within a pool of adhesive carried by a well structure mounted to the exterior surface of the voice coil such that the diaphragm is allowed to move in both a lateral direction and a vertical direction within the well structure while the adhesive cures, thus maintaining the original shape of the surround and substantially preventing misalignment of the voice coil within the magnetic gap of the motor during operation of the loudspeaker.

17 Claims, 3 Drawing Sheets

LOUDSPEAKER AND METHOD OF ASSEMBLING SAME

FIELD OF THE INVENTION

This invention relates to loudspeakers, and, more particularly, to a method of assembling a loudspeaker in which deformation of the surround and tolerance stack-up which can create dynamic misalignment of the voice coil relative to the magnetic gap are substantially eliminated.

BACKGROUND OF THE INVENTION

Loudspeakers generally comprise a frame, a motor structure, a diaphragm, a lower suspension or spider and an upper suspension or surround. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the surround, which, in turn, is mounted to the upper end of the frame. The lower suspension or spider is connected at one end to a seat formed in the frame at a point between its upper and lower ends. The free ends of the diaphragm and spider are mounted to the voice coil and support it within the magnetic gap between the pole piece and top plate of the motor structure, with the former of the voice coil concentrically disposed about the pole piece. In some speaker designs, a dust cap is mounted to the diaphragm in position to overlie the voice coil and pole piece to protect them from contaminants.

In the course of operation of a speaker of the type described above, electrical energy is supplied to the voice coil causing it to axially move relative to the pole piece and within the magnetic gap formed between the top plate and pole piece. The diaphragm, spider and surround move with the excursion of the voice coil and are intended to collectively maintain the voice coil concentric to the pole piece within the magnetic gap. Nevertheless, a pervasive problem associated with speaker operation involves misalignment of the voice coil which can create noise, distortion and/or speaker failure.

Problems with voice coil misalignment can be attributed to different factors, some involving techniques for manufacturing speaker components and others relating to the method of assembling the speaker components. Currently, it is typical for a manufacturer of loudspeakers to purchase the surround and diaphragm as a pre-assembled unit from an outside vendor. Often the same vendor manufactures both parts, and it is presumed that such vendor can more efficiently interconnect the diaphragm and surround at its facility than can the speaker manufacturer. Unfortunately, it is not uncommon for the combined diaphragm-surround assembly to be shipped to the speaker manufacturer in such a way that the surround becomes deformed.

In a conventional speaker assembly operation, the frame and motor structure are initially interconnected, and then the voice coil is secured within the magnetic gap of the motor by the lower suspension or spider. With the voice coil in position, the diaphragm-surround assembly is attached by first gluing the apex of the diaphragm along the outer surface of the former of the voice coil and then gluing the surround onto a flange at the upper end of the frame. The surround is allowed to "float" or move atop the flange as the glue dries.

One problem created by this assembly operation is due to tolerance "stack-up," or accumulation, in the components assembled prior to affixing the surround. As noted above, the motor, frame, spider and voice coil are all interconnected before attaching the diaphragm-surround assembly, and the dimensional variations of these elements within design tolerances may result in a lack of concentricity between the voice coil, and frame at the completion of the final assembly step. Further, the deformation of the surround may also result in a lack of concentricity between the outside diameter of the surround and its inside diameter.

In theory, by allowing the surround to float or move along the flange at the upper end of the frame while its glue dries, problems with lack of concentricity due to tolerance stack-up and/or deformation of the surround are overcome. It has been found that this is not adequate in some applications, particularly high excursion speaker designs. The cross-sectional shape of the surround is a carefully engineered parameter in the overall speaker design, and substantially affects the excursion response of the loudspeaker particularly when the excursions are high. Once the surround has been deformed, it is unlikely to return to its original profile or shape, or cannot do so because of a lack of concentricity with the flange at the upper end of the frame. As a result, when a deformed surround is attached to the frame, one side or area of the surround is typically stretched or extended to some extent whereas another area is compressed. In response to movement of the voice coil in either direction, the area of the surround which was stretched during assembly reaches its limit of extension or compression before other areas of the surround. When one area of the surround extends to a greater or lesser extent than another area of the surround, it tends to tilt or twist with the movement of the voice coil, especially at high excursions. This, in turn, causes the diaphragm and voice coil to twist or tilt in the same fashion and can be characterized as dynamic misalignment. When the voice coil becomes misaligned with the magnetic gap of the motor structure by such tilting or twisting motion, the result is the creation of noise, distortion and potential speaker failure due to direct parts contact.

In addition to the misalignment of the voice coil noted above, current assembly techniques may create an initial offset in a vertical direction. The connection between the diaphragm and voice coil is typically quite tight to maintain concentricity, and to ensure that a good bond is created in order to avoid a failure at the diaphragm-voice coil interface. Conventionally, the apex of the diaphragm is placed along the exterior of the voice coil against the spider or some other vertical reference point on the former of the voice coil, irrespective of the position of the surround. But since the surround and diaphragm are typically interconnected and assembled as a unit, as noted above, it is not uncommon for the surround to be displaced in a vertically upward or downward direction due to tolerance stack-up within the already assembly components, e.g. the motor structure, frame, spider and voice coil. As a result of such vertical displacement, the surround can be initially extended or depressed and will not assume its desired vertical profile after the assembly operation is completed.

SUMMARY OF THE INVENTION

It is therefore among the objectives of this invention to provide a loudspeaker, and a method of assembling same, in which dynamic misalignment of the voice coil with the magnetic gap of the motor structure is substantially eliminated, and the incidence of noise and distortion is reduced.

These objectives are accomplished in a method of assembling a loudspeaker in which the motor structure and frame are interconnected, the voice coil is initially secured within the magnetic gap of the motor by the lower suspension and then the diaphragm and surround are installed by first affixing the surround to a flange at the upper end of the frame so that its outer diameter of the surround is concentric to its inner diameter, and then inserting the lower end of the diaphragm within a pool of adhesive carried by a well structure mounted to the exterior surface of the voice coil such that the diaphragm is allowed to move in both a lateral direction and a vertical direction within the well structure while the adhesive cures.

This invention is predicated on the concept of accommodating both deformation of the surround and tolerance stack-up within elements of the loudspeaker while permitting the surround to assume as close to its original, design shape and position within the speaker as possible. With respect to the shape of the surround, in the presently preferred embodiment a ring is formed in the flange at the upper end of the frame having a diameter which is equal to the original outside diameter of the surround. Because the inner diameter of the surround is constrained by its connection to the diaphragm, affixing the outer diameter of the surround to the frame in a position against the ring tends to cause the surround to assume its original shape with its inner and outer diameters concentric to one another.

Tolerance stack-up is accommodated by the manner in which the diaphragm is secured to the voice coil. In one presently preferred embodiment, a diaphragm structure is provided which comprises an upper diaphragm mounted to the surround and a lower diaphragm having the general cross-sectional shape of a "W" with an outer section connected to the surround and an inner section mounted to the upper diaphragm. A protrusion is formed at the juncture of the inner and outer sections of the lower diaphragm. A sleeve formed with an adhesive trough or well is attached to the outer surface of the former of the voice coil in position so that the protrusion of the lower diaphragm can be inserted within the interior of the well. The well has a bottom wall connected to a pair of opposed side walls which are spaced from one another in a lateral direction and extend generally vertically upwardly from the bottom wall. Upon assembly of the diaphragm and surround, the surround is affixed by adhesive against the ring on the flange at the upper end of the frame and then the protrusion of the lower diaphragm is inserted within a pool of adhesive located within the well of the sleeve carried by the voice coil. The protrusion of the lower diaphragm is allowed to move both in a lateral direction and in a vertical direction within the well before the adhesive cures to account for tolerance stack-up within the components of the speaker in each of the lateral and vertical directions.

In an alternative embodiment, a standard diaphragm is employed having an upper end connected to the surround and a lower end insertable within the well structure of a sleeve mounted to the voice coil. The same lateral and vertical adjustment of the position of the lower end of the diaphragm within the well is provided as described above, and therefore problems of lack of concentricity between the surround, diaphragm and voice coil created by tolerance stack-up are substantially eliminated.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
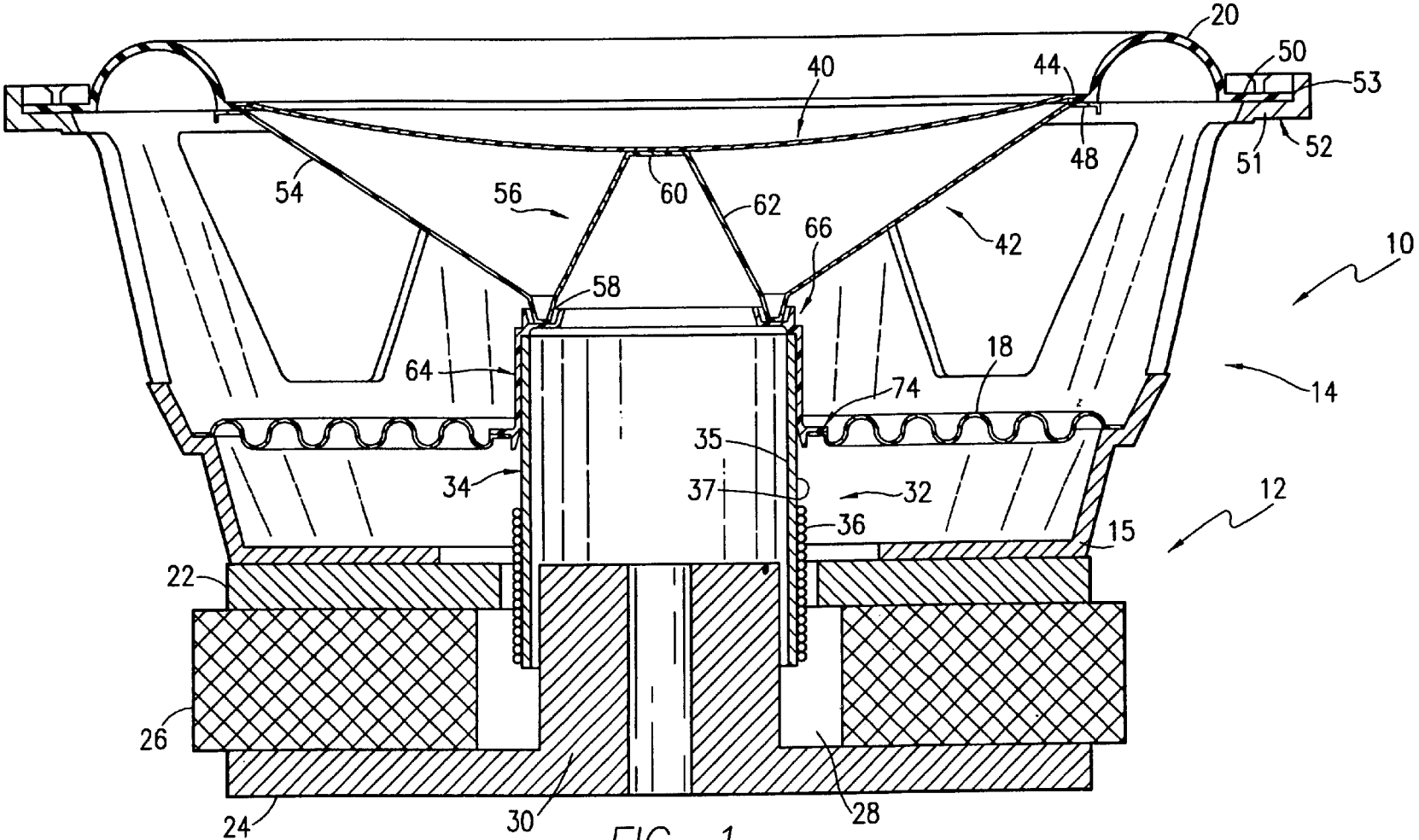
FIG. 1 is an elevational view, in partial cross section, of a speaker having one embodiment of the upper and lower diaphragm construction of this invention.
Figure 3:
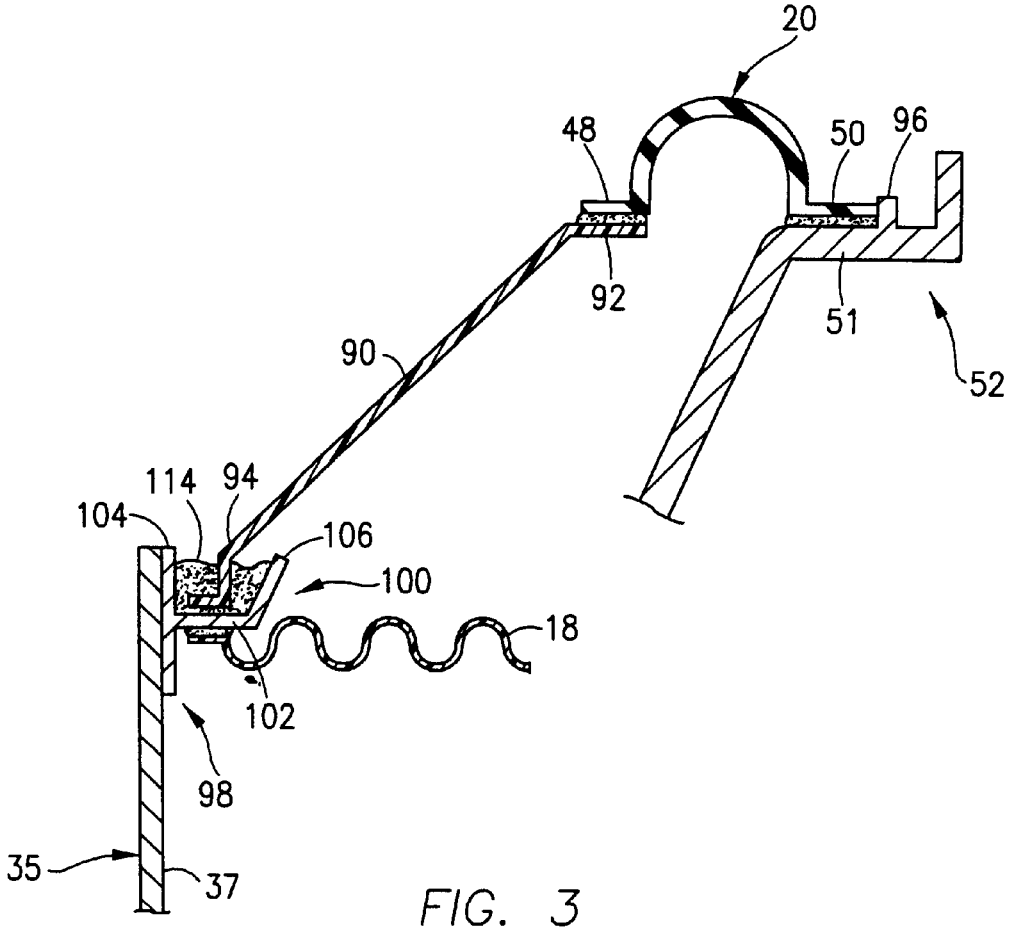
FIG. 3 is a partial view of a loudspeaker as depicted in FIG. 1, except of an alternative embodiment of the connection between a single diaphragm and the voice coil.

Referring now to FIGS. 1 and 3, a loudspeaker 10 is illustrated which is identical in each embodiment except for the inclusion of a different diaphragm construction as described in detail below The elements of speaker 10 common to the embodiments of FIGS. 1 and 3 include a motor structure 12, a frame 14 mounted to the motor structure 12, a lower suspension or spider 18 and an upper suspension or surround 20. Conventionally, the motor structure 12 includes a top plate 22 and a back plate 24 which are spaced from one another and mount a permanent magnet 26 therebetween. A vented pole piece 30 is integrally formed with and extends upwardly from the back plate 24 into a central bore 28 formed in both the magnet 26 and top plate 22. A magnetic gap is formed between the top plate 22 and the pole piece 30, as shown. A voice coil 32 is also provided which includes a hollow, cylindrical-shaped former 34 having an inner surface 35 and an outer surface 37 which receives a wire winding 36. The former 34 is concentrically disposed about the pole piece 30, and the voice coil 32 is axially movable within the magnetic gap during operation of the speaker 10.

For purposes of the present discussion, the terms "top" or "upper" refer to a location or direction toward the uppermost part of the loudspeaker 10 in the orientation as it is depicted in the FIGS., whereas the terms "bottom" or "lower" refer to the opposite direction. Additionally, the terms "inner" or "inwardly" refer to a direction toward the center of the loudspeaker 10 as shown in the drawings, while the terms "outer" or "outwardly" refer to a direction radially outwardly from the center of the loudspeaker 10.

Figure 2:
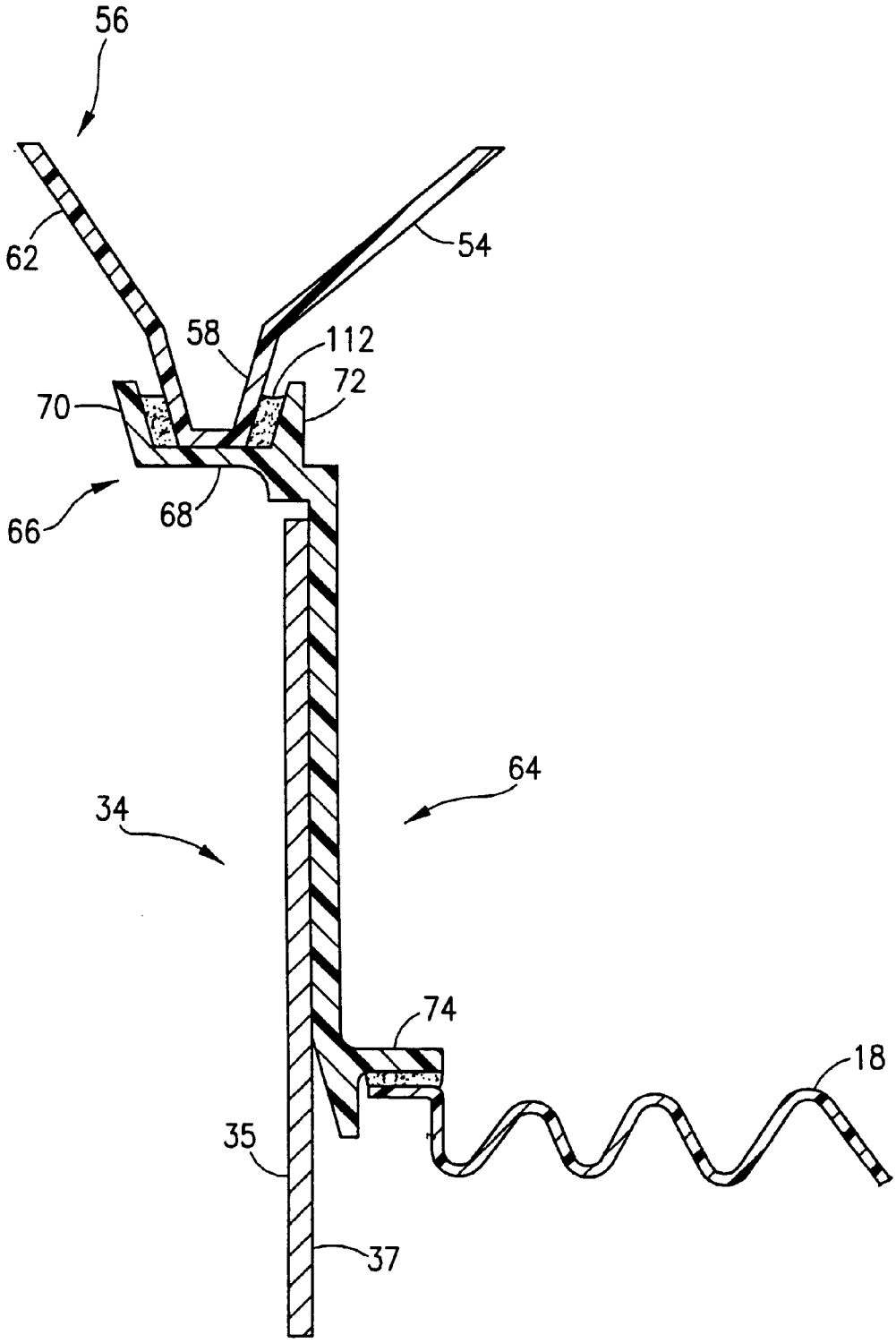
FIG. 2 is an enlarged view of the connection between the lower diaphragm, lower suspension and the voice coil depicted in FIG. 1.

With reference initially to FIGS. 1 and 2, in one presently preferred embodiment the voice coil 32 is held in place with respect to the pole piece 30 by the spider 18, the surround 20 and a two piece diaphragm construction which includes an upper diaphragm 40 and a lower diaphragm 42. The upper diaphragm 40 is generally circular in shape, and slightly tapered or arcuate in cross section from its outer edge 44 toward the center thereof. The outer edge 44 of the upper diaphragm 40 is mounted by adhesive to the upper surface of the inner edge 48 of the surround 20. As described in more detail below, the opposite, outer edge 50 of the surround 20 is connected to a flange 51 at the upper end 52 of the frame 14.

The lower diaphragm 42 is in the general shape of a "W" in cross section, including a tapered outer section 54 integrally formed with an inner section 56. The outer section 54 of the lower diaphragm 42 is connected at one end by adhesive to the lower surface of the inner edge 48 of the surround 20, and it tapers inwardly to form a protrusion 58 at the juncture with the inner section 56. As depicted in FIGS. 1 and 2, the inner section 56 of the lower diaphragm 42 has a substantially frusto-conical cross section defined by a generally planar top wall 60 and a tapered side wall 62. The tapered side wall 62 of the inner section 56 meets with the outer section 54 to form protrusion 58, and the top wall 60 of the inner section 56 is affixed by adhesive to the underside of the upper diaphragm 40.

The lower diaphragm 42 is mounted to the voice coil 32 by a sleeve 64 in position so that the inner section 56 of the lower diaphragm 42 overlies the hollow former 34 of the voice coil 32. In the presently preferred embodiment, the sleeve 64 is essentially a cylindrical-shaped member, formed of light weight but relatively stiff plastic or the like, which is mounted by adhesive to the outer surface 37 of the former 34. The upper end of the sleeve 64 includes an annular trough or well 66 having a bottom wall 68 and opposed side walls 70 and 72. The lower end of the sleeve 64 is formed with a generally horizontally extending platform 74. The spider 18 is adhesively mounted between a seat 15 formed in the frame 14 and the platform 74 at the lower end of sleeve 64. The protrusion 58 formed at the juncture of the outer section 54 and inner section 56 of the lower diaphragm 42 is received within and adhesively mounted to the well 66 at the top of the sleeve 64, as described more fully below.

With reference to FIG. 3, an alternative embodiment of this invention is shown which includes a single diaphragm 90 having an upper end 92 connected to the inner edge 48 of the surround 20, and a lower end 94. The outer edge 50 of the surround 20 abuts an annular ring 96 formed in or connected to the flange 51 at the upper end 52 of the frame 14, as described more fully below. Preferably, a sleeve 98 formed with an adhesive trough or well 100 is mounted to the outer surface 37 of the former 35 of voice coil 32 so that the well 100 is located in a position to receive the lower end 94 of the diaphragm 90. The well 100 is formed with a bottom wall 102 connected to a pair of side walls 104 and 106 which are laterally spaced from one another and extend generally vertically outwardly from the bottom wall 102.

Method of Assembly

The method of assembly of the speaker 10 is essentially the same for each of the embodiments depicted in the Figs. Initially, the frame 14 and motor structure 12 are interconnected in the orientation shown in FIG. 1. In particular, the lower end of the frame 14 rests on the top plate 22 of the motor structure 12 and is secured in place by screws, rivets or similar fasteners (not shown). The sleeve 64 of FIGS. 1 and 2, or the sleeve 98 of FIG. 3, is glued or otherwise permanently connected to the outer surface 37 of the former 35 of voice coil 32 so that the adhesive well 66 of sleeve 64 and the adhesive well 100 of sleeve 98 are positioned as shown.

The next step in the assembly operation is to secure the voice coil 32 in position within the magnetic gap of the motor structure 12 concentric to the pole piece 30. In the embodiment of the speaker 10 depicted in FIGS. 1 and 2, the inner end of the spider 18 is secured by adhesive to the bottom surface of the platform 74 of sleeve 64. Alternatively, the inner end of the spider 18 is mounted by adhesive to the bottom wall 102 of the adhesive well 100 formed in the sleeve 98 of the speaker 10 depicted in FIG. 3. With the inner end of the spider 18 secured to the voice coil 32, a gauge or fixture (not shown) is inserted along the inner surface 35 of the voice coil former 34. The gauge is intended to contact the pole piece 30 of the motor structure 12 and center the voice coil 32 with respect to the pole piece 30 and within the magnetic gap between the pole piece 30 and top plate 22. The voice coil 32 is moved vertically downwardly into position relative to the pole piece 30, until the outer edge of the spider 18 rests within the seat 15 formed in the frame 12, when it is adhesively connected. Even if the voice coil 32 and spider 18 are somewhat non-concentric relative to the frame 14, concentricity between the voice coil 32 and pole piece 30 is ensured by the gauge and the seat 15 of the frame 14 is sufficiently wide to allow the outer edge of the spider 18 to adhesively connect thereto regardless of a lack of precise concentricity.

As described above, it has been found that difficulties often arise during the final stages of speaker assembly when the diaphragm and surround are mounted in place. In particular, deformation of the surround 20 resulting from problems with shipment or otherwise, and tolerance stack-up within the already assembled motor structure 12, frame 14, voice coil 32 and spider 18, both can contribute to a lack of concentricity between elements of the speaker 10. These problems are addressed by method of assembly and construction of the connections between the surround 20 and frame 14, and between the diaphragm 42 or 90 and the voice coil 32.

With reference to FIGS. 1 and 2, the upper end 52 of the frame 14 has a flange 51 formed with a vertically upwardly extending ring 53. The ring 53 has a diameter which is equal to the outside diameter of the outer edge 50 of surround 20, according to the original design of the surround 20. Similarly, the flange 51 at the upper end 52 of frame 14 in the embodiment of the speaker 10 illustrated in FIG. 3 has an annular ring 96 whose diameter is equal to the outside diameter of the outer edge 50 of the surround 20. In each embodiment, the surround 20 is glued to the flange 51 so that the outside diameter of its outer edge 50 abuts either the ring 53 of FIGS. 1 and 2 or the ring 96 of FIG. 3. This forces the surround 20 to assume its original shape, at least along the outside diameter.

Although not required in accordance with the teachings of this invention, it is preferable to mount the diaphragms 42, 40 and the diaphragm 90, to the surround 20 before either are connected to other elements of the speaker 10. This mounting step can be done by the supplier of the diaphragms 40, 42 or 90 and the surround 20, or by the speaker manufacturer. Fixtures or other assembly devices are employed to make certain that the connection between the surround 20 and the diaphragms 40 and 42 of FIGS. 1 and 2, and between the surround 20 and the diaphragm 90 of FIG. 3, are precise and do not change the original inner diameter shape and dimension of the surround 20. In either case, the inside diameter of the inner edge 48 of surround 20 is maintained in its original shape by the rigid material forming the diaphragms 42, 90. As such, once the surround 20 is forced to assume its original outside diameter as described above, it is believed that any deformities in the original shape of the surround 20 which may have been present at the time of assembly are substantially eliminated.

With the surround 20 in position against the ring 53 or the ring 96 atop the flange 51 at the upper end 52 of frame 14, the diaphragms 42 or 90 are then secured to the voice coil 32. In the embodiment of FIGS. 1 and 2, the protrusion 58 formed at the juncture of the outer section 54 and inner section 56 of inner diaphragm 42 is received within a pool of adhesive 112 within the well 66 of the sleeve 64. Similarly, the lower end 94 of diaphragm 90 is placed into a pool of adhesive 114 within the well 100 of the sleeve 98 in the embodiment of FIG. 3. In either case, the lateral spacing between the side walls 70, 72 of well 66 and between the side walls 104, 106 of well 100 allow for movement of the diaphragms 42 and 90, respectively, in the lateral direction. Further, since the side walls 70, 72 of well 66 and side walls 104, 106 of well 100 extend vertically upwardly from their respective bottom walls 68 and 102, vertical movement of the diaphragms 42 and 90 is permitted within the wells 66 and 100. Consequently, before the adhesive within the adhesive pools 112 and 114 cures, the lower end of each of the diaphragms 42 and 90 is allowed to move in both the lateral direction and the vertical direction to account for tolerance stack-up in the previously assembled elements of the speaker 10, e.g. the motor structure 12, frame 14, voice coil 32 and spider 18. This ensures that the surround 20 assumes as close to its original shape and position within the speaker 10 as possible.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof For example, the rings 53 and 96 shown as being integrally formed in the flange 51 at the upper end 52 of the frame 14. It should be understood that a separate annular element or guide could be releasably or permanently mounted to the flange, such as a gasket or the like, to provide a surface against which the outer edge 50 of the surround 20 could rest in order to assure its original outside diameter. Alternatively, a ring or other element could be located along the flange 51 at the upper end 52 of the frame 14 in position to engage the outer portion of the interior of surround 20, designated by the reference number 116 in FIG. 3 for example, instead of contacting the outer edge 50. This would also serve to force the surround 20 to assume the original shape and dimension of its outside diameter.

Therefore, it is intended that the invention not be limited to the particular embodiment disclosed as the best mode contemplated for carrying out this invention, but that the invention will include all embodiments falling within the scope of the appended claims.

What is claimed is:

1. A method for assembling a loudspeaker, comprising:

(a) providing a motor structure including a pole piece spaced from a top plate to form a magnetic gap, a frame having a lower end connected to the motor structure and an upper end, a voice coil, a lower suspension, an upper suspension having an inner and outer diameter and a diaphragm structure having a first end connected to the inner diameter of the upper suspension and a second end;

(b) attaching the lower suspension between the voice coil and the frame so that the voice coil is located within the magnetic gap in a position substantially concentric to the pole piece of the motor structure of the loudspeaker;

(c) affixing the upper suspension to the upper end of the frame in a position wherein the outer diameter of the upper suspension is substantially concentric to the inner diameter of the upper suspension;

(d) securing the second end of the diaphragm within an adhesive well extending from the outer surface of the voice coil to connect the diaphragm to the voice coil.

2. The loudspeaker of claim 1 in which step (b) includes providing a sleeve affixed to the outer surface of the voice coil, said sleeve having a surface to which one end of the lower suspension is mounted.

3. The method of claim 1 in which step (d) includes providing a sleeve affixed to the outer surface of the voice coil, said sleeve being formed with an adhesive well having a bottom wall connected to a pair of side walls which are spaced from one another in a first direction and which extend outwardly from the bottom wall in a second direction.

4. The method of a claim 3 in which step (d) includes inserting the second end of the diaphragm structure within a pool of adhesive located in the adhesive well and allowing the position of the second end to move within the adhesive well in both the first direction and the second direction before the adhesive cures.

5. The method of claim 1 in which step (c) includes affixing the upper suspension to the upper end of the frame so that the outer diameter of the upper suspension engages an annular ring located at the upper end of the frame.

6. A method for assembling a loudspeaker, comprising:

(a) providing a motor structure including a pole piece spaced from a top plate to form a magnetic gap, a frame having a lower end connected to the motor structure and an upper end, a voice coil, a lower suspension, an upper suspension having an inner and outer diameter and a diaphragm structure having a first end connected to the inner diameter of the upper suspension and a second end;

(b) attaching the lower suspension between the voice coil and the frame so that the voice coil is located within the magnetic gap in a position substantially concentric to the pole piece of the motor structure of the loudspeaker;

(c) affixing the upper suspension to the upper end of the frame in a position wherein the outer diameter of the upper suspension is substantially concentric to the inner diameter of the upper suspension;

(d) providing a sleeve with an adhesive well having a bottom wall connected to a pair of side walls which are spaced from one another in a first direction and which extend outwardly from the bottom wall in a second direction; and (e) inserting the second end of the diaphragm structure within a pool of adhesive located in the adhesive well and allowing the position of the second end to move within the adhesive well in both the first direction and the second direction before the adhesive cures.

7. The method of claim 6 in which step (b) includes attaching the lower suspension to the bottom wall of the adhesive well of the sleeve opposite the sidewalls.

8. The method of claim 6 in which step (a) includes providing a diaphragm structure comprising an upper diaphragm connected to the upper suspension, and a one-piece lower diaphragm having an outer section connected to the upper suspension, an inner section overlying the voice coil and a protrusion formed at the juncture of the inner and outer sections.

9. The method of claim 8 in which step (d) includes inserting the protrusion of the lower diaphragm into the adhesive well of the sleeve.

10. The method of claim 6 in which step (c) includes affixing the upper suspension to the upper end of the frame so that the outer diameter of the upper suspension engages an annular ring formed at the upper end of the frame.

11. A method for assembling a loudspeaker, comprising:

(a) providing a motor structure including a pole piece spaced from a top plate to form a magnetic gap, a frame having a lower end connected to the motor structure and an upper end, a voice coil, a lower suspension, an upper suspension having an inner and outer diameter and a diaphragm structure having a first end connected to the inner diameter of the upper suspension and a second end;

(b) attaching the lower suspension between the voice coil and the frame so that the voice coil is located within the magnetic gap in a position substantially concentric to the pole piece of the motor structure of the loudspeaker;

(c) affixing the upper suspension to the frame so that the outer diameter of the upper suspension engages an annular guide at the upper end of the frame causing the outer diameter of the upper suspension to assume a shape substantially concentric to the inner diameter of the upper suspension;

(d) securing the second end of the diaphragm within an adhesive well extending from the outer surface of the voice coil to connect the diaphragm to the voice coil.

12. A loudspeaker, comprising:

a motor structure including a voice coil having a former with a hollow interior defining an inner surface, and an outer surface which mounts a wire winding;

a frame having an upper end and a lower end, said lower end of said frame being connected to said motor structure;

a lower suspension connected between said frame and said voice coil;

an upper suspension connected to said upper end of said frame;

an upper diaphragm connected to said upper suspension;

a one-piece lower diaphragm having an outer section connected to said upper suspension, and an inner section which forms a protrusion at the juncture with said outer section;

a sleeve mounted to said outer surface of said former, said sleeve being formed with an adhesive well which is positioned to receive and mount said protrusion of said lower diaphragm.

13. The loudspeaker of claim 12 in which said adhesive well has a bottom wall connected to a pair of side walls which are spaced from one another in a first direction and which extend outwardly from said bottom wall in a second direction.

14. The loudspeaker of claim 13 in which said adhesive well receives a pool of adhesive, said protrusion of said lower diaphragm being movable within said adhesive well in both said first direction and said second direction before said pool of adhesive cures.

15. A loudspeaker, comprising:

a motor structure including a voice coil having a former with a hollow interior defining an inner surface, and an outer surface which mounts a wire winding;

a frame having an upper end and a lower end, said lower end of said frame being connected to said motor structure;

a lower suspension connected between said frame and said voice coil;

an upper suspension connected to said upper end of said frame;

a diaphragm having an upper end connected to said upper suspension and a lower end;

a sleeve mounted to said outer surface of said former, said sleeve being formed with an adhesive well which is positioned to receive and mount said lower end of said diaphragm.

16. The loudspeaker of claim 15 in which said adhesive well has a bottom wall connected to a pair of side walls which are spaced from one another in a first direction and which extend outwardly from said bottom wall in a second direction.

17. The loudspeaker of claim 16 in which said adhesive well receives a pool of adhesive, said lower end of said diaphragm being movable within said adhesive well in both said first direction and said second direction before said pool of adhesive cures.

* * * * *